US009835399B1

(12) United States Patent
Lessard

(10) Patent No.: US 9,835,399 B1
(45) Date of Patent: Dec. 5, 2017

(54) MONOCORE SILENCER WITH INTEGRAL CONICAL FLASH HIDER

(71) Applicant: Sig Sauer, Inc., Newington, NH (US)

(72) Inventor: Ethan Lessard, East Kingston, NH (US)

(73) Assignee: SIG SAUER, INC., Newington, NH (US)

( * ) Notice: Subject to any disclaimer, the term of this patent is extended or adjusted under 35 U.S.C. 154(b) by 0 days.

(21) Appl. No.: 15/089,165

(22) Filed: Apr. 1, 2016

Related U.S. Application Data

(60) Provisional application No. 62/142,241, filed on Apr. 2, 2015.

(51) Int. Cl.
*F41A 21/30* (2006.01)
*F41A 21/34* (2006.01)
*F41A 21/32* (2006.01)

(52) U.S. Cl.
CPC ..... *F41A 21/30* (2013.01); *F41A 21/325* (2013.01); *F41A 21/34* (2013.01)

(58) Field of Classification Search
CPC ..... F41A 21/30; F41A 21/34; F41A 21/36
USPC ..... 89/14.2–14.4; 181/223
See application file for complete search history.

(56) References Cited

U.S. PATENT DOCUMENTS

| | | | | |
|---|---|---|---|---|
| 3,385,164 | A * | 5/1968 | Hubner | F41A 21/30 181/223 |
| 6,308,609 | B1 * | 10/2001 | Davies | F41A 21/30 181/223 |
| 8,490,535 | B1 * | 7/2013 | Moore | F41A 21/30 181/223 |
| 2012/0272818 | A1 * | 11/2012 | Dueck | F41A 21/30 89/14.4 |
| 2014/0360807 | A1 * | 12/2014 | McKenzie | F41A 21/30 181/223 |
| 2015/0260472 | A1 * | 9/2015 | Smith | F41A 21/30 89/14.2 |
| 2016/0109205 | A1 * | 4/2016 | Coppinger | F41A 21/30 89/14.4 |

* cited by examiner

*Primary Examiner* — Reginald Tillman, Jr.
(74) *Attorney, Agent, or Firm* — Finch & Maloney PLLC

(57) ABSTRACT

A muzzle end accessory for a firearm includes features to both suppress sounds and flashes associated with firing of the firearm. The features that provide sound and flash suppression may be formed, at least partially, in a core structure that is interior to the accessory and thus protected from damage by contact with external elements. The core structure may be of a unitary structure, promoting structural integrity and ease of manufacturing.

18 Claims, 3 Drawing Sheets

MONOCORE SILENCER WITH INTEGRAL CONICAL FLASH HIDER

RELATED APPLICATIONS

This application claims benefit of U.S. Provisional Application No. 62/142,241, titled MUZZLE END ACCESSORY MOUNT FOR A FIREARM filed Apr. 2, 2015, the contents of which are hereby incorporated by reference herein.

TECHNICAL FIELD

The present disclosure relates to an accessory for a firearm that includes features of a flash suppressor and of a sound suppressor that are incorporated into a common structure.

BACKGROUND

Accessories are available for attachment to the muzzle of a firearm to accomplish various effects when the firearm is operated. Sound suppressors or silencers are an example of such an accessory and that include one or more chambers through which a bullet passes, when fired. The chambers receive rapidly expanding gases that propel the bullet, as the bullet passes, and slow the release of the gases to the external environment. The slowed release of propellant gases and the corresponding slowed reduction in pressure results in a reduced report when the bullet exits the firearm through the sound suppressor.

Flash suppressors or flash hiders are another type of accessory that includes features to promote the dispersion and/or mixing of unburnt gunpowder and propellant gases and air in a manner that reduces the overall magnitude of a muzzle flash that may occur with firing of a firearm. In this respect, any impact that such a flash might have on vision of an operator of the firearm may be reduced. Conventional flash hiders or suppressors include prong-like structures that are cantilevered from a muzzle end of a firearm. Such structures are prone to breakage and/or interference with the external environment.

SUMMARY

According to one example embodiment, an accessory for a firearm is disclosed. The accessory includes a housing mountable to the firearm in alignment with a firing axis of the firearm. A core structure is positionable within the housing in alignment with the firing axis. The core structure includes a proximal bullet receiving portion and a distal bullet discharge portion. A series of baffles at least partially define a series of suppression chambers in the core structure that extend from the proximal bullet receiving portion and towards the distal bullet discharge portion. A flash suppression structure that defines a cross section that lies orthogonal to the firing axis and that expands in area at positions further away from the proximal bullet receiving portion of the core structure to promote dispersion of propellant gases existing the distal bullet discharge portion.

According to one embodiment, the housing includes a housing base that is mountable to a muzzle of the firearm and a housing body that is securable to the housing base. The housing base includes an alignment feature to align the core structure with the firing axis of the firearm. The housing body includes a tapered cylinder constructed and arranged to secure the core structure in alignment with the firing axis of the firearm when secured to the housing base.

At least some of the series of suppression chambers progressively decrease in volume from the proximal bullet receiving portion and toward the distal bullet discharge portion, according to some embodiments. The series of suppression chambers may be defined, in cooperation, by portions of the core structure and the housing body. Each baffle of the series of baffles may define an aperture about the firing axis that is constructed and arranged to allow passage of a bullet. At least some the series of baffles may define the aperture with portions of the baffle that are axially offset along the firing axis.

According to some embodiments, the core structure defines at least a portion of a distal face of the accessory, with the distal face defining a bullet discharge opening of the distal bullet discharge portion. The distal bullet discharge opening may include a distal most portion of the flash suppression structure. The flash suppression structure includes a truncated cone structure that expands in area at positions further away from the proximal bullet receiving portion of the core structure. The truncated cone structure may extend from one of the series of baffles toward the distal face of the accessory. According to some embodiments, the core structure is a unitary structure.

The subject matter of this application may involve, in some cases, interrelated products, alternative solutions to a particular problem, and/or a plurality of different uses of a single system or article.

The present disclosure is not intended to be limited to a system or method that must satisfy one or more of any stated objects or features. Modifications and substitutions by one of ordinary skill in the art are considered to be within the scope of the present disclosure.

BRIEF DESCRIPTION OF THE FIGURES

In the drawings, different embodiments of the invention are illustrated in which.

DETAILED DESCRIPTION

Disclosed herein are example embodiments of a muzzle end accessory for a firearm that includes features to both suppress sounds and flashes associated with firing of the firearm. The features that provide sound and flash suppression may be formed, at least partially, in a core structure that is interior to the accessory and thus protected from damage by contact with external elements. The core structure may be of a unitary structure, promoting structural integrity and ease of manufacturing. The baffles and/or end cap of the sound suppressor may directly support the flash suppressor.

Figure 1:
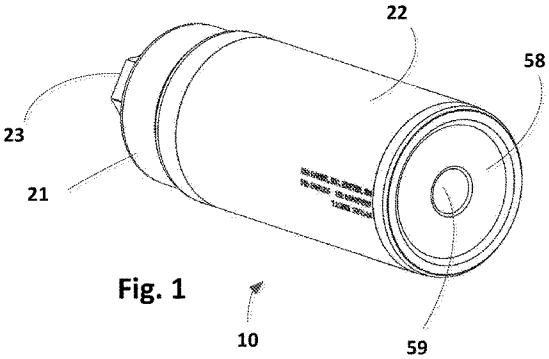
FIG. 1 is a perspective view of an accessory that includes sound and flash suppression features, according to one embodiment.
Figure 2:
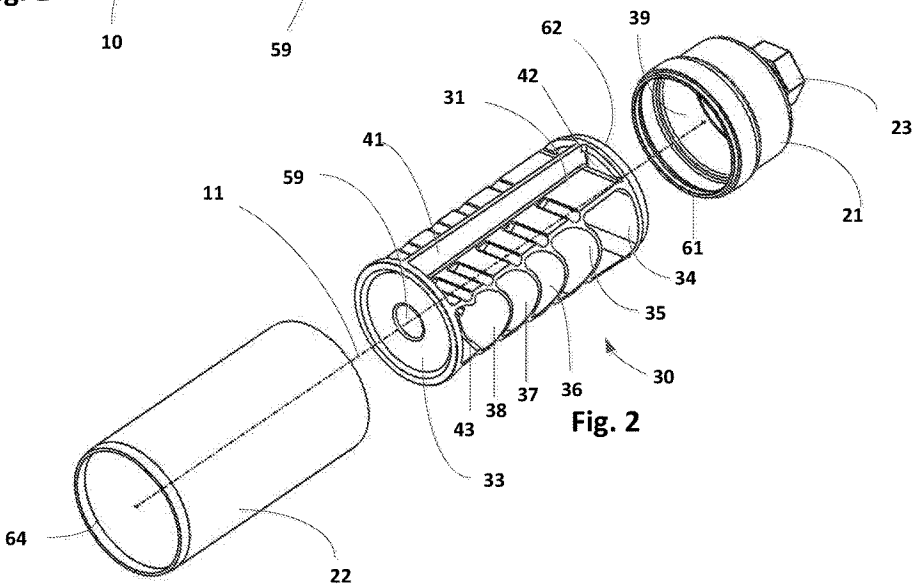
FIG. 2 is an exploded assembly view of the embodiment of FIG. 1.

Turn now to the figures and initially FIGS. 1 and 2 that show a perspective view of an assembled muzzle end accessory and an exploded assembly view of the accessory, respectively. The accessory 10 includes a housing having a housing base 21 and a housing body 22 and that supports a core structure 30 that includes portions of the sound suppressing features and flash suppressing features. The housing base 21 includes a mount 23 that secures the accessory 10 to the muzzle end of a firearm (not shown) such that a firing axis (i.e., central axis along which the firearm discharges a bullet, when fired) is aligned with a firing axis 11 of the accessory. A housing body 22 assembles to the housing base 21 in a manner that secures and aligns the core structure 30 within the accessory 10.

Figure 3:
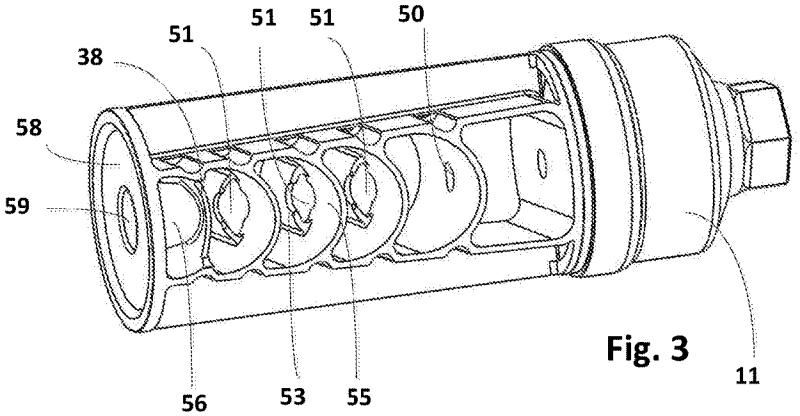
FIG. 3 is a perspective side view of the embodiment of FIG. 1, with a portion of the housing removed to show internal features.

The core structure includes features that define at least portions of sound suppression chambers that suppress the report associated with firing of a firearm. As may be seen in FIGS. 2-4, the core structure includes a series of baffles 34, 35, 36, 37, 37, 38 that at least partially define sound suppression chambers. A first sounds suppression chamber 39 is formed between the housing base 21 and a proximal most baffle 34 of the core structure 30. A bullet, when fired from the firearm, enters the first sound suppression chamber 39 through of the accessory immediately after exiting the muzzle of the firearm. Propellant gases follow the bullet into the accessory and are initially allowed to expand within the volume of the first sound suppression chamber 39. The volume of the first sounds suppression chamber 39 lies within the interior of the housing base 21 and the first baffle 34, with the accessory in an assembled state. The first sound suppression chamber may additionally include volumes 40 that lie between the housing body 22 and lateral portions of the core structure 41, with fluid communication provided to between these volumes via the core structure openings 42 shown in FIGS. 2-4.

Figure 4:
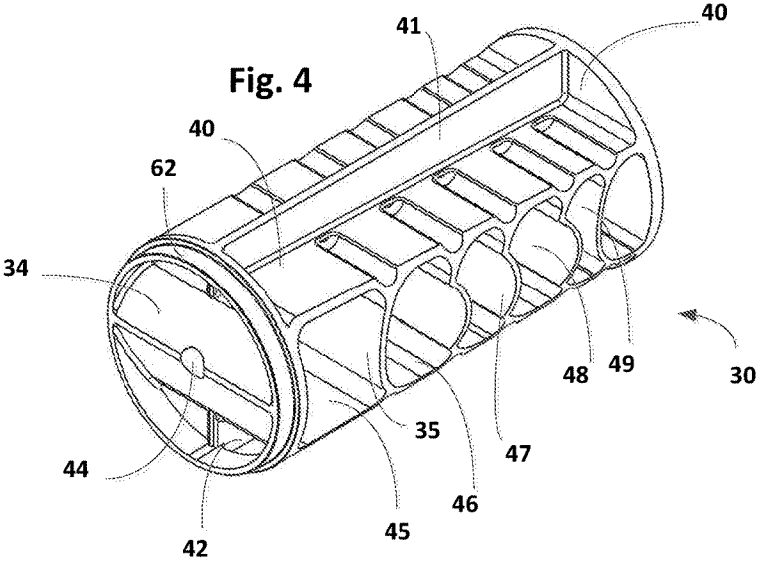
FIG. 4 is a perspective view of a core structure of the embodiment of FIG. 1.

Apertures between sound suppression chambers may include features to accomplish various desirable effects. By way of example, FIG. 4 shows an aperture 44 formed in a "V" shaped structure of the first baffle 34 that may promote vortex shedding as a bullet passes through the aperture 44. The "V" shaped baffle may additionally direct propellant gases and airflow through the openings 42 and into the volumes 40 of the first suppression chamber that lies between the housing body and lateral portions 41 of the core structure.

A second suppression chamber is defined, in the illustrated example embodiment, between first 34 and second 35 baffles of the core structure 30 in cooperation with portions of the housing body 22. The second chamber 45 extends from opposed, internal curved walls of the housing body along a generally rectangular cross section defined by the core structure 30 between the first 34 and second 35 baffle, with the second baffle 35 having a convex shape facing into the second suppression chamber 45. The convex shape may promote some degree of vortex shedding, similar to the "V" shaped first baffle. The internal volume of the second suppression chamber 45 is less than the overall internal volume of the first suppression chamber 39, although other arrangements are possible and are contemplated. The apertures 44, 50 in each of the first and second baffles are centered about the firing axis 11 and are shaped to generally conform to the size and shape of a bullet with which the accessory is designed to be used.

The subsequent third, fourth, fifth, and sixth suppression chambers 46, 47, 48, and 49 lie downstream of the second suppression chamber 45, along the firing axis 11. Each of the subsequent suppression chambers has a progressively smaller volume, although other arrangements are possible and contemplated. The subsequent chambers extend between opposite, internal curved walls of the housing body and are further defined by third, fourth, fifth, and sixth baffles 36, 37, 38, and 43 of the core structure 30, among other features. Although the illustrated embodiment includes a series of six suppression chambers of decreasing volume along the firing axis, it is to be appreciated that other embodiments may have any number of suppression chambers, formed with volumes that are similar to one another or that may even increase along the firing axis.

Baffles may define different types of apertures between suppression chambers, according to various embodiments. By way of example, each of the third, fourth, and fifth baffles 36, 37, and 38 of the core structure 30 define apertures 51 between suppression chambers that have portions 53, 55 spaced from one another along the firing axis 11. That is, different parts of a baffle that are separated from one another along the firing axis, and that each define a portion of a circle or other arcuate shape by which a bullet will pass when moving through the accessory. Apertures constructed in this manner may prevent the passage of propellant gases, when the bullet is present in the aperture, while promoting a greater rate of passage and pressure decay once the bullet has passed the aperture.

Figure 5:
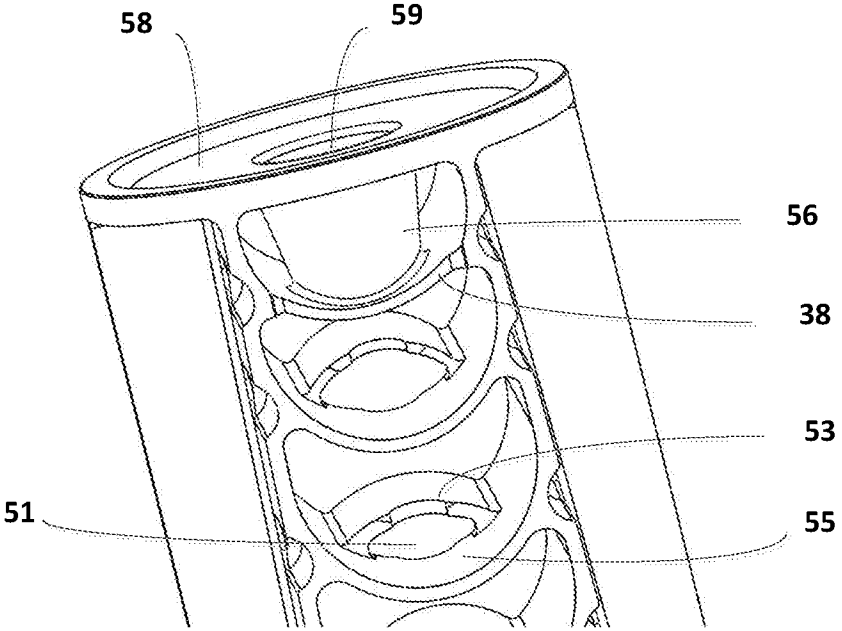
FIG. 5 is a close up view showing flash suppression features of the core structure of the embodiment shown in FIG. 1.

The core structure may define at least portions of a structure that suppress a muzzle flash. As may be seen in FIGS. 3 and 5, a conical structure 56 extends from an aperture in the sixth baffle 38 and towards the distal face 58 of the core structure. In this respect, the muzzle flash suppressor is formed of and/or supported by the structure of the flash suppressor. The conical structure is centered along the firing axis and provides an expanding volume at points further from the firearm. The expanding volume of the flash suppressor promotes dispersion of propellant gases and reduction of any muzzle flash, so as to prevent the vision of an operator of the firearm from being impacted. Although the conical structure 56 is illustrated as a truncated cone having a continuous, solid surface, it is to be appreciated that other constructions are also contemplated, including structures having oblong cross sections and/or apertures that provide fluid communication through portions of the flash suppressor structure.

The core structure may support the structure of the flash suppressor. By way of example, the distal face 58 of the core structure 30 defines a distal most end and opening 59 of the flash suppressor and a baffle 38 provides the opening through which a bullet enters the flash suppressor. In this respect, each end of the flash suppressor structure is supported by another portion of the core structure that is located further away from the firing axis, in a radial direction. This may help minimize or eliminate cantilevering of the flash suppressor structure itself and, in turn, better support the flash suppressor structure. In the illustrated example embodiment, a single baffle 38 and distal face 58 support the structure of the flash suppressor. It is to be appreciated, however, that additional or alternate arrangements are also contemplated, including an embodiment with additional ribs and/or baffles that support the flash suppressor.

The housing, in the illustrated example embodiment, includes a housing base 21 and housing body 22 that may be assembled to enclose the core structure therein. The core structure 30 may be positioned and/or aligned with respect to the housing base 21 by various features. FIG. 2 shows a shoulder 61 in the base that mates with a corresponding feature 62 on the core structure to align each of the core structure 30 and housing base 21 with one another and the firing axis 11 of the accessory. The housing body 22 may include a slight taper, corresponding to a taper formed into the outermost surfaces of the core structure. Such a taper may serve to promote alignment of the core structure with respect to the housing base and housing body when the housing body is secured to the base. The distal most end of the housing body includes a lip 64, as shown, that interacts with a corresponding feature of the core structure to prevent the core structure from moving forward within the housing. The lip is constructed to leave at least a portion of the distal face 58 of the core structure exposed to the external environment, although other constructions are also possible.

Components of the accessory may be constructed according to different approaches. The core structure, according to some example embodiments, may be formed as a unitary structure. The term "unitary", as used herein, refers to the structure being manufactured from a single, continuous piece of material. One example of a unitary core structure includes a core structure that is formed by molding or casting, with material removed therefrom after the molding or casting, such as through a machining process. The core structure may be made of different types of materials and is generally constructed of heat resistant materials, including but not limited to steel, aluminum, thermoset plastics, and other types of plastics.

It is to be appreciated that a firearm may be operated with or without a first and/or a second accessory assembled to the firearm by an assembly mount. By way of example, according to some approaches, an operator may fire a firearm with a compensator assembled to the first connector of an assembly mount and without any accessories assembled to a second mount. Alternately an operator may operate a firearm with an accessory, such as a silencer, assembled to the firearm via the second connector of an accessory mount. The operator may, additionally or alternately, use the firearm without accessories mounted at either of the first or second connectors of the accessory mount.

While several embodiments have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of this disclosure. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of this disclosure is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, along with other embodiments that may not be specifically described and claimed.

All definitions, as defined herein either explicitly or implicitly through use should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

What is claimed is:

1. An accessory for a firearm, comprising:

a housing mountable to the firearm in alignment with a firing axis of the firearm;

a core structure positionable within said housing in alignment with the firing axis, the core structure including a proximal bullet receiving portion and a distal bullet discharge portion;

a series of baffles that at least partially define a series of suppression chambers in said core structure that extend from said proximal bullet receiving portion and towards said distal bullet discharge portion, the series of suppression chambers including at least a proximal suppression chamber and a distal suppression chamber, the proximal suppression chamber positioned between the proximal receiving portion and the distal bullet discharge portion, the distal suppression chamber positioned between the proximal suppression chamber and the distal bullet discharge portion, the proximal suppression chamber having a first volume, and the distal suppression chamber having a second volume that is smaller than the first volume; and a flash suppression structure provided by said core structure and that defines a cross section that lies orthogonal to the firing axis and that expands in area at positions further away from said proximal bullet receiving portion of said core structure to promote dispersion of propellant gases exiting the distal bullet discharge portion;

wherein the flash suppression structure is a conical structure positioned within the distal suppression chamber and having a first end and an opposing second end, wherein the first end of the flash suppression structure is in contact with and supported by one of said series of baffles and the second end is in contact with and supported by a distal face of the distal bullet discharge portion of the core structure.

2. The accessory of claim 1, wherein said housing includes a housing base that is mountable to a muzzle of the firearm and a housing body that is securable to said housing base.

3. The accessory of claim 2, wherein said housing base includes an alignment feature to align said core structure with the firing axis of the firearm.

4. The accessory of claim 3, wherein said housing body includes a tapered cylinder constructed and arranged to secure said core structure in alignment with the firing axis of the firearm when secured to said housing base.

5. The accessory of claim 2, wherein at least some of said series of suppression chambers progressively decrease in volume from said proximal bullet receiving portion and toward said distal bullet discharge portion.

6. The accessory of claim 5, wherein said series of suppression chambers are defined by said core structure and said housing body.

7. The accessory of claim 5, wherein each baffle of said series of baffles defines an aperture about the firing axis that is constructed and arranged to allow passage of a bullet.

8. The accessory of claim 7, wherein at least some said series of baffles define said aperture with portions of said baffle that are axially offset along the firing axis.

9. The accessory of claim 1, wherein the core structure defines at least a portion of a distal face of said accessory, said distal face defining a bullet discharge opening of said distal bullet discharge portion.

10. The accessory of claim 9, wherein said distal bullet discharge opening includes a distal most portion of said flash suppression structure.

11. The accessory of claim 10, wherein said flash suppression structure includes a truncated cone structure that expands in area at positions further away from said proximal bullet receiving portion of said core structure.

12. The accessory of claim 11, wherein said truncated cone structure extends from one of said series of baffles toward said distal face of said accessory.

13. The accessory of claim 9, wherein said flash suppression structure is directly supported by at least one of said series of baffles.

14. The accessory of claim 1, wherein said core structure is a unitary structure.

15. The accessory of claim 1, in combination with said firearm.

16. The accessory of claim 1, further comprising a central suppression chamber positioned between the proximal suppression chamber and the distal suppression chamber, the central suppression chamber having a third volume that is smaller than the first volume and that is larger than the second volume.

17. The accessory of claim 1, further comprising at least a first lateral volume that is formed along the firing axis between the housing and the core structure on a first side of the core structure, and at least a second lateral volume that is formed along the firing axis between the housing and the core structure on a second side of the core structure opposite the first side.

18. The accessory of claim 1, further comprising a lateral divider on the core structure that divides at least one lateral volume between the housing and the core structure into at least two lateral volumes.

* * * * *